US005566936A

United States Patent [19]

Newgarden et al.

[11] Patent Number: 5,566,936

[45] Date of Patent: Oct. 22, 1996

[54] ELECTRONIC TABLE TENNIS GAME

[75] Inventors: Joseph Newgarden; Charles W. McDonald, both of Gallatin, Tenn.

[73] Assignee: Joseph E. Newgarden, Jr., Gallatin, Tenn.

[21] Appl. No.: 386,214

[22] Filed: Feb. 8, 1995

Related U.S. Application Data

[63] Continuation of Ser. No. 116,858, Sep. 7, 1993, abandoned, which is a continuation of Ser. No. 906,364, Jul. 6, 1992, abandoned.

[51] Int. Cl.[6] ..... A63B 63/00

[52] U.S. Cl. ..... 273/30; 273/29 A

[58] Field of Search ..... 273/30, 29 R, 273/29 A, 327, 55 A, 371, 372, 373, 374; 482/84

[56] References Cited

U.S. PATENT DOCUMENTS

| | | | |
|---|---|---|---|
| 2,709,592 | 8/1945 | McAvoy . | |
| 3,117,783 | 1/1964 | Reid | 273/30 |
| 3,369,812 | 2/1968 | McKee . | |
| 3,817,519 | 6/1974 | Leonhart . | |
| 3,874,664 | 4/1975 | Faurot et al. | 273/29 A |
| 4,119,838 | 10/1978 | Genuit . | |
| 4,129,299 | 12/1978 | Busch | 273/327 |
| 4,351,026 | 9/1982 | Phillips . | |
| 4,363,484 | 12/1982 | Breslow et al. . | |
| 4,491,954 | 1/1985 | Genuit . | |
| 4,514,621 | 4/1985 | Knight et al. . | |
| 4,534,557 | 8/1985 | Bigelow | 273/55 A |
| 4,772,018 | 9/1988 | Inniger . | |
| 4,917,380 | 4/1990 | Gatchel | 273/30 |
| 4,969,645 | 11/1990 | Barbador . | |
| 5,095,433 | 3/1992 | Botarelli et al. . | |

*Primary Examiner*—Theatrice Brown

*Attorney, Agent, or Firm*—Polster, Lieder, Woodruff & Lucchesi, L.C.

[57] ABSTRACT

A table tennis game is provided that can be used with an automatic table tennis ball serving device, the game including a plurality of sensors which can be arranged on the surface of the table to serve as targets, the sensors having means for detecting the impact of a table tennis ball. The game contains a programmable microcomputer connected to the sensors which converts the impact into a score, calculates the automatic server's score, times the game, and displays the respective scores and elapsed time of play.

4 Claims, 4 Drawing Sheets

ELECTRONIC TABLE TENNIS GAME

This is a continuation application of application Ser. No. 08/116,858, filed on Sep. 7, 1993, abandoned, which is a continuation of Ser. No. 07/906,364, filed Jul. 6, 1992, abandoned.

BACKGROUND OF THE INVENTION

This invention relates to a table tennis game, and in particular, to a table tennis game that can be played by one player, requiring the player to return a served ball and score by striking one or more targets strategically placed on the table surface.

Table tennis is a popular recreational activity commonly known as "ping-pong". The traditional game is played by two players, each positioned at an opposite end of the table so as to volley the table tennis ball across the net affixed at the mid-point of the table. Four players can play a doubles game in similar fashion.

The object of the traditional game is to make a shot across the net that the opposing player cannot return. A point is scored when one player cannot return a shot. Therefore, a successful or skillful player is one who can strategically place the ball at a point on the table that will cause the ball to carom out of the opponent's reach or to carom in a such a manner as to be difficult for the other player to return.

One draw back of traditional table tennis or "ping-pong", is that it takes at least two players to play. It is desirable, therefore, to have a game that can be played by only one player. To that end, ball-throwing or ball-serving devices serve a useful purpose. Ball-serving devices or robots are well known to the art. Generally speaking, a ball serving device serves a ball to the player and the player returns the shot to a net or other ball catching device affixed to the ball serving machine. Although such table tennis ball serving devices or "robots" allow a player to play alone, they do not have the capacity to require the player to return a shot with particular accuracy or refinement. As stated above, the player simply returns the shot into a net or catching device surrounding the robot. The robot allows the player to develop overall ability in the game, such as returning a serve in the general field of play. Robots play does not reward a player for stroke accuracy or placement.

The present invention is designed to be used with an automatic table tennis ball serving device or robot such as those described in U.S. Pat. Nos. 4,844,458; 4,854,588; and 4,917,380, all to Gatchel et al. and all assigned to the inventor of the present invention, the disclosures of which are hereby incorporated by reference. The present invention consists, basically, of a plurality of low profile sensors that can be placed strategically on the table tennis table surface. The sensors can accurately record a "hit" made by a table tennis ball striking the sensor. The sensors are electronically connected to a score-keeping device that keeps track of the player's score as well as the robot's score and the elapsed time of the game. Therefore, the game rewards the player who can direct his shot with accuracy and speed. This provides a more challenging game and also provides a method for the player to hone shot-making skills.

SUMMARY OF THE INVENTION

An object of the present invention is to provide a table tennis game that can be played by one player which requires the player to score by making strategically placed shots.

Another object of the invention is to provide a table tennis game that can be used with an automatic ball serving device.

Another object of the invention is to provide a table tennis game that employs sensors that can accurately record a "hit" made by a table tennis ball striking the sensor.

Still another object of the invention is to provide a table tennis game that provides a score-keeping mechanism that keeps track of the player's score, the automatic server's score, and the amount of time in which to play a game.

Still another object of the invention is to provide a game that allows the player to select the difficulty of the game by manipulating the number of sensors, size of the sensors, the point level assigned to each sensor, time of the game, or the difficulty of the serve or shot made by the automatic ball server.

Another object of the invention is to provide a table tennis game that can be used with a conventional table tennis table.

Yet another object of the invention is to provide a game that is simple and economical to manufacture, low cost, easy to set-up and to use, and well suited for its intended purpose.

Briefly stated, an automatic table tennis game to be used on a table with a table tennis ball serving device, the game having a plurality of sensors capable of arrangement on the surface of the table so as to provide one or more targets for the player returning a table tennis ball served by the ball serving device, the sensors having means for detecting impact of a table tennis ball, a micro computer means for converting the impact into a score, and means for displaying the score of the player, the score of the serving device, and the time of the game or variations thereof. The level of the difficulty of the game can be varied by the selection of the sensor size, the shot value, time of the game, and speed or trajectory of the served ball.

DESCRIPTION OF THE PREFERRED EMBODIMENT

Figure 1:
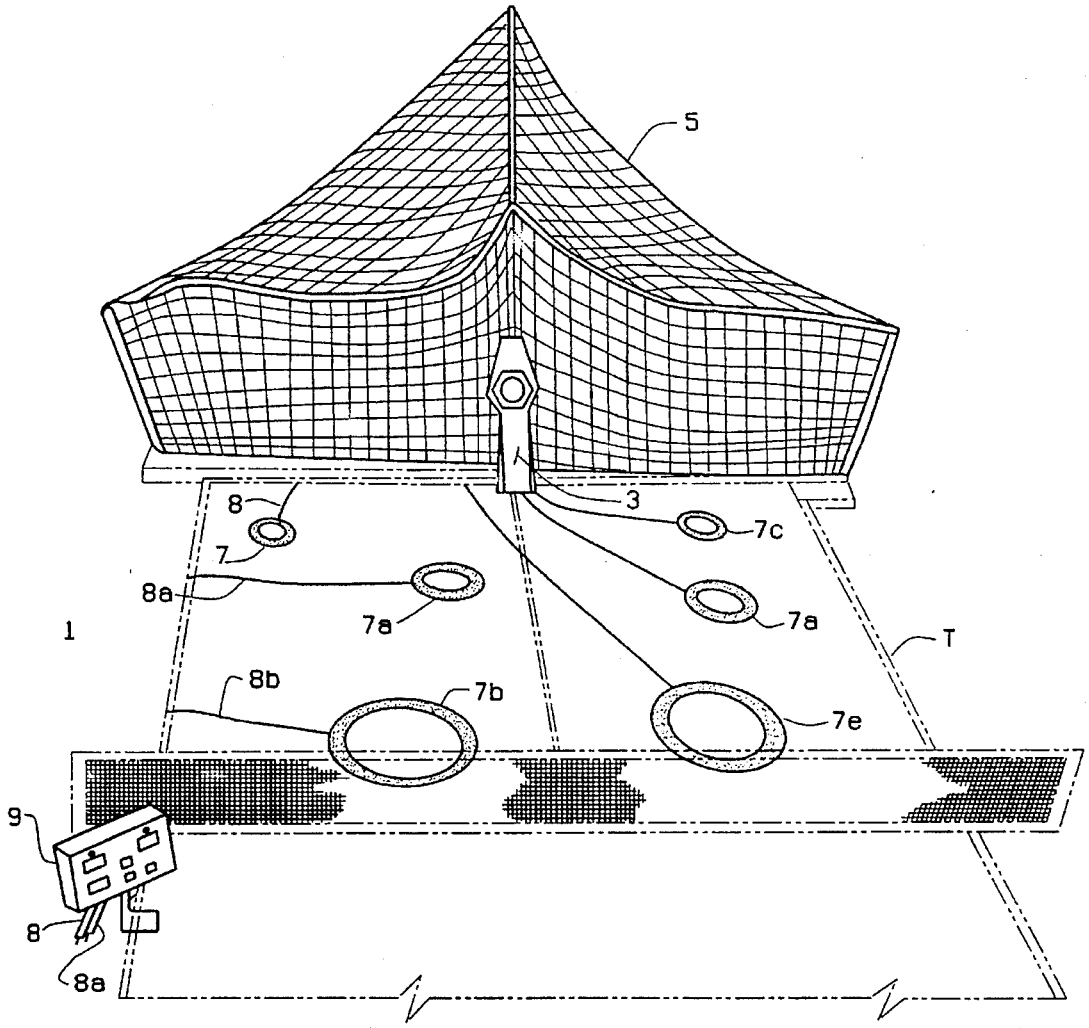
FIG. 1 is a perspective view of one arrangement of the table tennis game of the present invention placed on a table, shown in phantom, employing a robot table tennis ball sensor.

Referring now to the drawings, a table tennis game of the present invention is shown generally in FIG. 1 at 1. Game 1 is shown in one of an infinite number of arrangements on a table tennis table T, shown in phantom to illustrate environment. In this particular embodiment, game 1 is shown in use with a robot table tennis serving device 3 and the surrounding net 5 so as to provide a source of balls to be used in the game as will be explained hereinafter.

Game 1, as shown in FIG. 1, includes a plurality of sensors pads 7, 7*a*, 7*b*, 7*c*, 7*d*, 7*e*. The sensor pads serve as targets at which the human player aims a shot when returning a table tennis ball served by the robot server 3.

Figure 7:
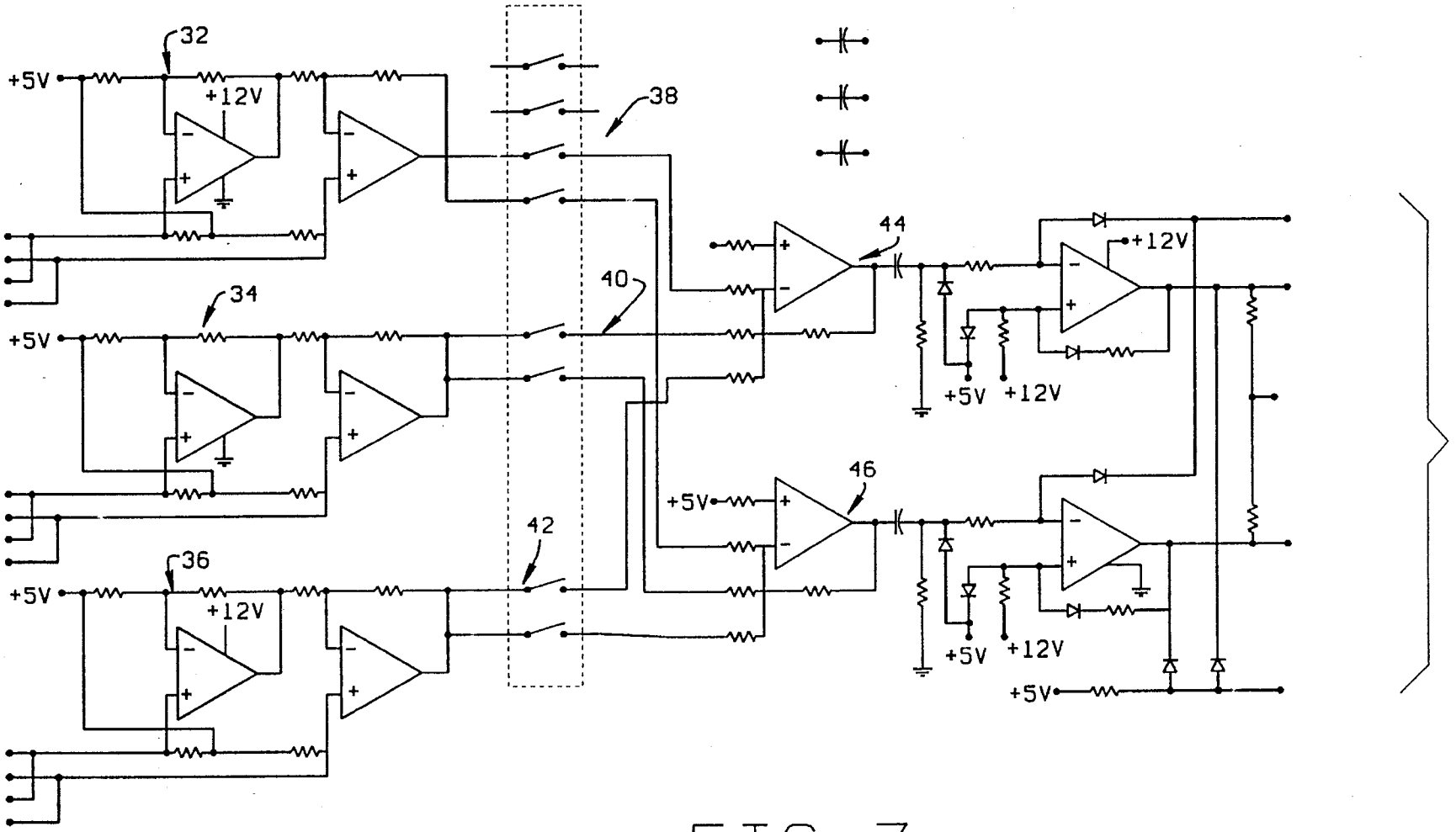
FIG. 7 is a schematic illustrating the impact signal circuitry of the present invention.

The game utilizes a control box, shown generally at 9. Control box 9 houses a microprocessor unit programmed to coordinate and integrate the elements of the game. Control box 9, which is removably mounted to table T, is connected to sensors 7, 7*a*, 7*b*, etc. by wires 8, 8*a*, 8*b*, etc. Control box 9 also serves as a score board and control center with appropriate displays and input keys (see FIG. 7) as will be explained in detail.

In use, game 1 can be played with an automatic robot server 3 in the following manner:

Sensors 7, 7*a*, 7*b* etc. are placed on the top of table T on the opposite side of table T from the player (on the same side as robot 3). A game begins with a player selecting the number and size of sensors 7, 7*a*, 7*b*, etc. that the player wishes to use. The player can arrange the sensors on table T in any desired arrangement. The player then mounts the control box 9 on table T and connects wires 8, 8*a*, 8*b*, etc. to the control box. Wires 8, 8*a*, 8*b*, etc. are long enough to allow placement of the sensors anywhere on table T.

The player can select the type of shot the robot delivers and the frequency of the shots as described in U.S. Pat. No. 4,854,588 the disclosure of which is hereby incorporated by reference. The game begins when the player presses an input key pad on the control box to start counting down the game time. The object of the game is beat the robot by scoring, for example 21 points, before the robot scores 21 points. The player scores by returning a ball served by the robot and making his shot strike a sensor, for example, by striking sensor 7. Control box 9 can be programmed to assign any one of a range of points, for example, 1–3 points per sensor, thereby varying the point value of the sensors and altering the difficulty of the game as will be explained hereinafter.

In the preferred embodiment, the robot scores points from the amount of time it takes to play the game. For example, if the amount of time selected for a game is 21 minutes (programmable into control box 9 as will be explained), the robot will score one point for every minute that elapses from the time the game starts until it ends. In this embodiment the robot wins if 21 minutes elapses before the human player scores 21 points; the player wins if he scores 21 points before 20 minutes have elapsed. Should either of these two conditions not occur, the game will continue until either the robot or the human player is two points ahead of the other.

The game allows many options for the player to match the difficulty of the game to his or her skill level. For example, the length of the game can be changed; the more time in the game, the easier it is for the player to win. The second option that can be varied is the number of sensors used. The more sensors placed on table T, the easier it is for the player to score. Sensors 7, 7*a*, 7*b*, etc. may be varied in size. The larger the sensor, the easier it is for the player to strike the sensor and therefore the easier it is for the human player to win. Finally, control box 9, as stated, can be programmed to set the point level for the sensors. For example, point levels could be set at 1, 2, or 3 points per strike. Obviously, the higher the score per strike, the easier it is for the human player to win.

Finally the difficulty of the serve or shot of the table tennis ball delivered by the robot be adjusted. The various perimeters that can be adjusted can include the spin placed on the ball, ball speed, frequency of the shot deliver, height of the ball trajectory, and whether the ball is served to one spot on table T or served to different spots. As stated above, the adjustment of the robot is as disclosed in U.S. Pat. No. 4,854,588 and is incorporated by reference.

Figure 2:
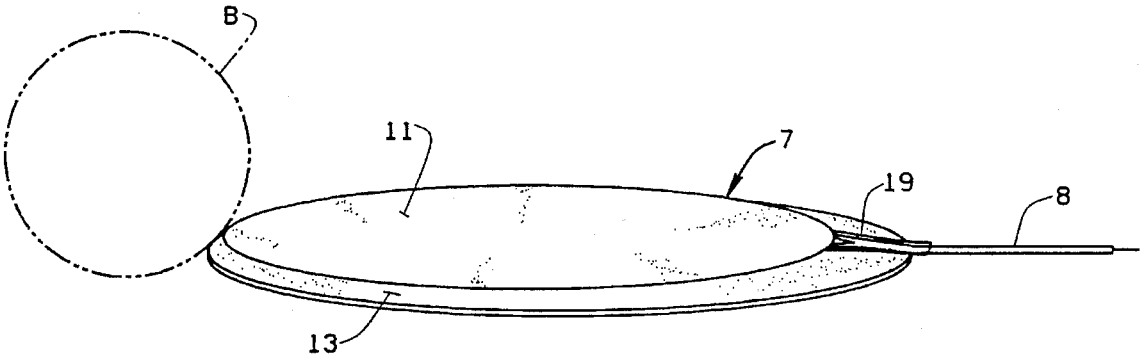
FIG. 2 is a perspective view of a sensor element of the present invention shown with a table tennis ball in phantom, illustrating the low profile of the sensor.

Turning now to a more detailed description of the elements of the game, FIG. 2 illustrates a sensor 7 used in conjunction with the present invention. In FIG. 2, sensor 7 is shown next to a table tennis ball B in phantom so as to demonstrate the low profile aspect and construction of sensor 7. It is to be understood that sensor 7 can be of any diameter. Generally, the game employs sensors of three different diameters as shown in FIG. 1.

Figure 3:
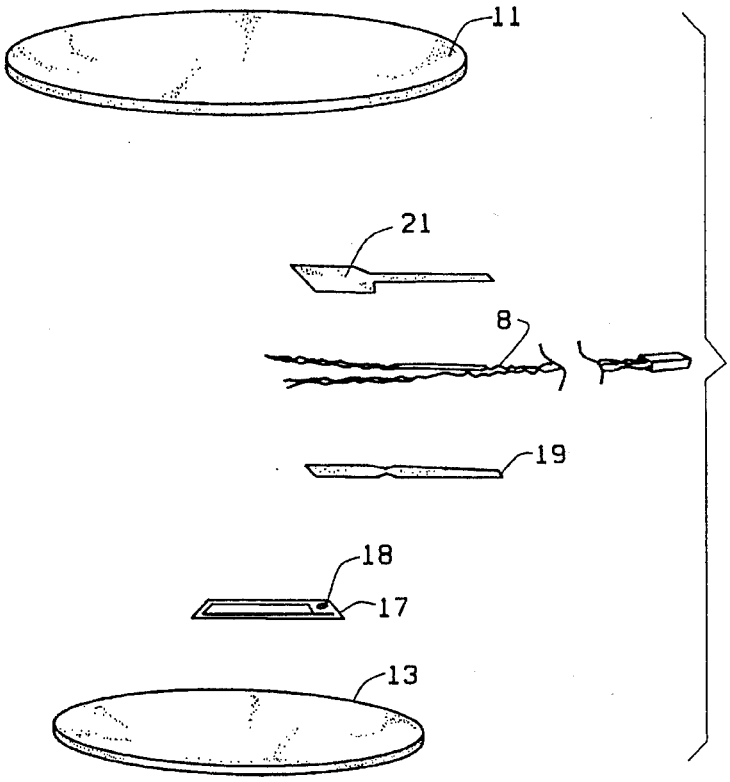
FIG. 3 is an exploded view of a sensor element of the present invention.

Sensor 7, shown in greater detail in FIG. 3, includes an impact pad 11, an impact disc 13 and an impact sensor element, shown at 17, interposed between pad 11 and disc 13. As previously stated, pad 11 and disc 13 are of variable diameter depending upon the contact area size desired for the sensor.

Impact disc 13 is made of an appropriate material, for example, 0.76 mm thick polystyrene plastic. Impact disc 13 serves as the base of sensor 7.

Piezo film sensor element 17 is bonded to disc 13, near the periphery. Piezo film sensor 17 includes a piezo film material that generates voltage when a compressive or expansive stress is applied. Element 17 has a wire connector 18 on the top side and has a suitable adhesive on the bottom side. Sensor element 17 is bonded to disc 13 so that any flexing of disc 13, for example, due to the contact of a table tennis ball on sensor 7, will apply stress to sensor element 17. Sensor element 17 generates voltage when stressed and is electrically connected to control box 9 (FIG. 1, 6), by wires, for example, a wire pair 8. The electrical voltage generated by element 17 when sensor 7 is struck by a table tennis ball travels along wire pair 8 to control box 9 and is processed by the microcomputer contained therein as will be explained below.

Wire pair 8 is secured in place by strain relief support 19, a small, slightly rigid, transparent plastic component that provides support to wire 8 for a short distance beyond the periphery of disc 13. Flexible film 21, with a suitable adhesive on the bottom surface, serves to bond wire 8 to strain relief 19 and bond strain relief 19 to disc 13. Therefore, film 21 must be oversized as to strain relief 19. The area covered by film 21 includes connector 18 on sensor element 17 providing strength and protection to the connection.

Figure 4:
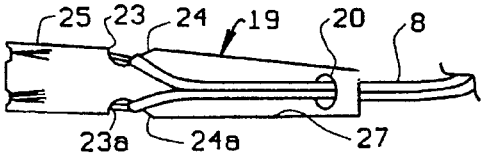
FIG. 4 is a top plan view of an illustrative embodiment of a strain relief component of the present invention.
Figure 5:
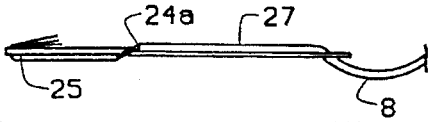
FIG. 5 is a side elevational view of the strain relief component of FIG. 4.

FIGS. 4 and 5 give a more detailed view of strain relief 19. Strain relief 19 has wire access hole 20 formed in one end of elongate section 27. Wire pair 8 is introduced up through hole 20 and along elongate portion 27. Wire pair 8 is split and each segment laced through indention 23 and 23*a* resting against shoulders 24 and 24*a* respectively and then laced under rectangular segment 25. The ends of wire pair 8 are exposed and secured to connector 18 on sensor element 17 and bent back across rectangular segment 25 so as to be secured by film 21. If a force or strain is exerted on either wire of the pair 8, the two segments of wire pair 8 are braced against shoulders 24 and 24*a* of slots 23 and 23*a* respectively so as to prevent wire pair 8 and the connected element 17 from being pulled away from disc 13.

Impact pad 11 is of an appropriate diameter so as to cover the sensor element 17 and strain relief element 19 and center over pad 13. Pad 11 can be formed from appropriate material, such as a high-density polyurethene foam with a very fine cell structure. Pad 11 is extremely flexible and may stretch more than 150% of its original length without failure.

Figure 6:
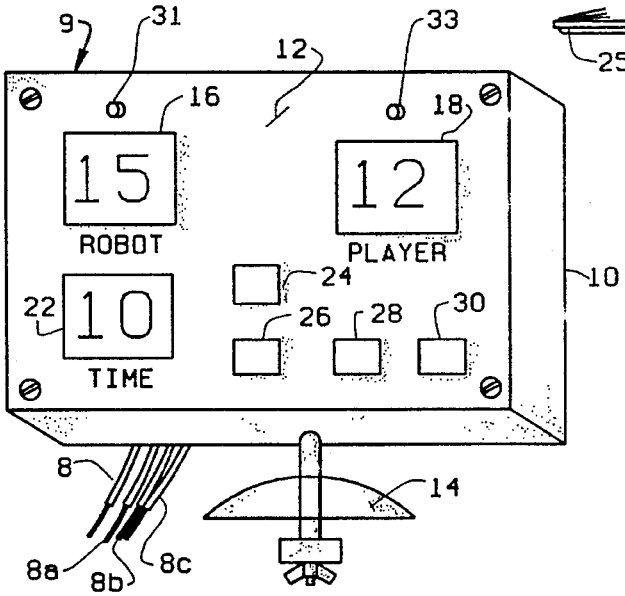
FIG. 6 is a front elevational view of the electronic control component of the table tennis game of the present invention.

Turning now to a detailed description of control box 9, shown in detail at FIG. 6. Control box 9 has a housing 10 that can be constructed in any convenient or functional configuration and constructed of appropriate material such as high impact plastic or light gauge metal. Mounting bracket 14 affixed to the bottom of housing 10 serves to mount control box 9 on the edge of table T so as to be visible to and in convenient reach of the player, yet remaining outside of the field of play. Face plate 12 serves as a score board, having displays, for example, a display 16 to display the robot server's score, a display 18 to display the human player's score, a display 22 to display the elapsed time of the game. Box 19 has input keys to initiate functions of the game. Input key 24 for example, can be pushed to increase the length of time of the game; input key 26 can be pushed to decrease the playing game of the game; input key 28 serves to reset the time controls; and input key 30 functions as a start switch which is pushed to begin the game. Lights 31, 33 can be color coded, for example red and green respectively, to indicate game on or game over. It should be noted that the configuration of face plate 12 as well as the design and placement of the displays, and design and placement of the input keys as well as the various functions of the input keys can be varied without departing from the scope of the invention.

A programmable microcomputer (shown in FIG. 8) is housed in control box 9 and functions to control the input from the sensors, for example, sensors 7, **7*a*, 7*b*, etc. (FIG. 1), and to provide timing and score keeping functions. User interface is provided by the input keys, for example, input keys 24, 26, 28 and 30 as well as by displays 14–18** as described above.

The input signal conditioning circuitry (FIG. 7) consists of three channels, 32, 34, and 36 with two inputs per channel. This provides for six inputs per game. Each channel's output is split and applied through switches 38, 40 and 42 to summing/latch circuits 44, 46. One of the latches represents, for example, a score of 1 point and the other a score of 2 points. Scoring for each channel is determined by closing the switch to either the "1" scoring latch or the "2" scoring latch. If both latches are selected, channel scores 3 points. Each channel can be independently set for 1, 2 or 3 points or points as desired.

Figure 8:
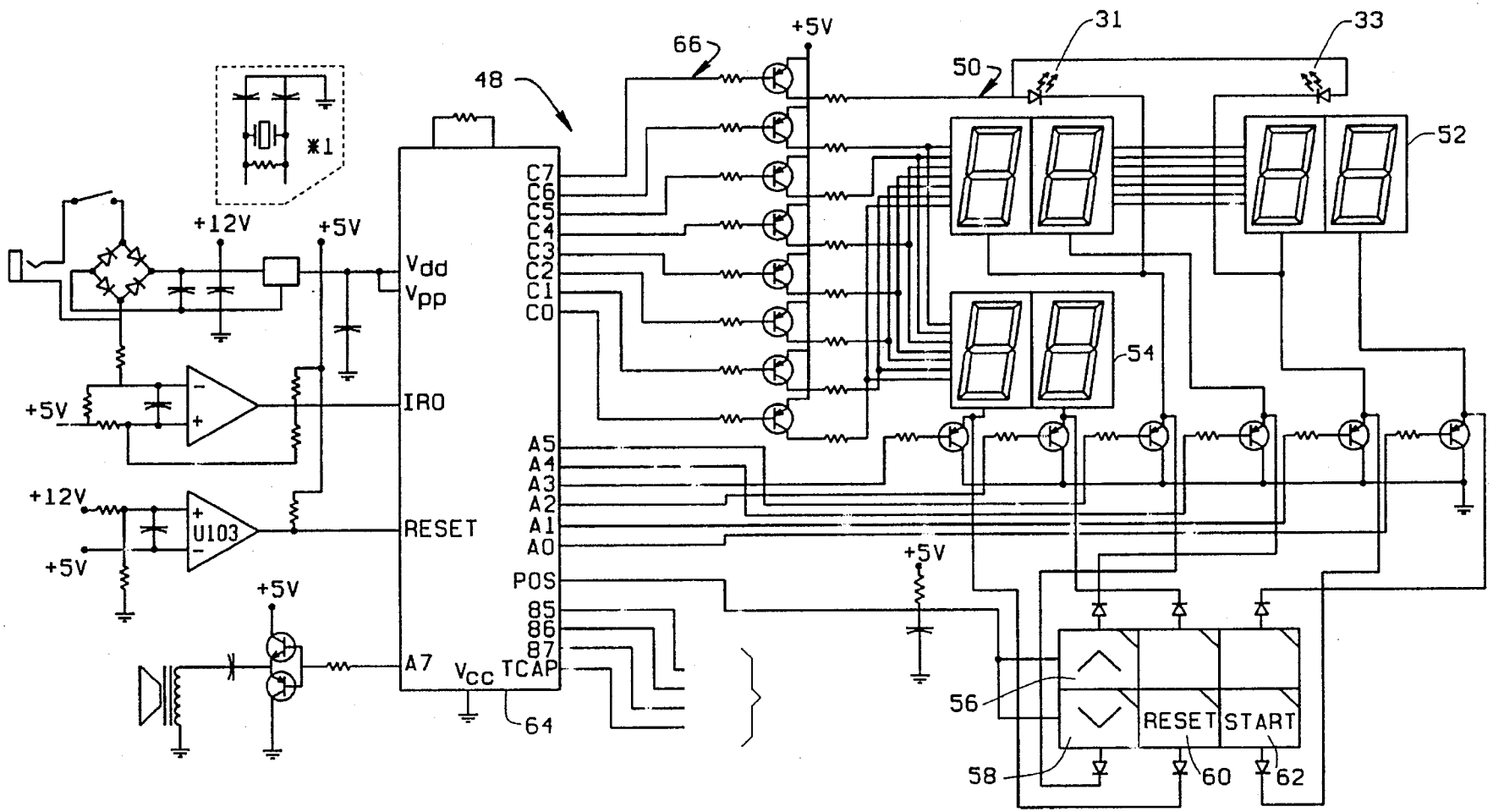
FIG. 8 is a schematic illustrating the microcomputer support circuitry of the present invention.

FIG. 8 illustrates the remainder of the electronic control circuitry shown generally at 48. Circuitry 48 is composed of displays 50, 52 and 54, the input switches 56, 58, 60 and 62, the microcomputer 64, and support circuitry 66. The microcomputer drives displays 50, 52 and 54 and also reads input keys 56, 58, 60 and 62; the microcomputer monitors the latch conditions and determines game status. The microcomputer is driven by a program which may be varied or enhanced without departing from the scope or spirit of the invention.

In view of the above, it will be seen that various objects and features of the present invention are achieved and other advantageous results are obtained. As various changes could be made in the above construction without departing from the scope of the invention, it is intended that all matter contained in the above description and shown in the accompanying drawings shall be interpreted as illustrative and not in a limiting sense.

Having thus described the invention, what is claimed and desired to be secured by Letters Patent is:

1. Table tennis apparatus for playing a game to be used by a human player on conventional table tennis table equipped with a centrally positioned table tennis net, comprising:

a table tennis ball serving device mounted to the table tennis table at one end thereof on one side of the table tennis net;

a plurality of movable and variably sized low profile sensors, randomly arranged on a surface of the table tennis table on the same side of the table tennis net as the table tennis serving ball serving device so as to provide predetermined randomly arranged targets for such human player striking a table tennis ball at an opposite end of said table tennis table from the table tennis ball serving device;

means within each sensor for converting the impact of a table tennis ball against each sensor into an electric impulse;

each sensor being connected to a microprocessor for integrating the functions of the game;

said microprocessor including means for preprogramming a score value for each sensor;

said microprocessor also including means for preprogramming an increment of time in which the human player must strike a sensor with a table tennis ball;

said microprocessor further including means for comparing the electrical impulse with the preprogrammed increment of time; and said microprocessor additionally including means for calculating and displaying a digital score based on the comparison between the electrical impulse and the preprogrammed increment of time;

whereby an occurrence of an electrical impulse within the preprogrammed increment of time results in a digital score for the human player and no occurrence of the electrical impulse within the preprogrammed increment of time results in a digital score for the table tennis ball serving device.

2. Table tennis apparatus for playing a game to be used by a human player on a table tennis table equipped with a centrally positioned table tennis ball net, the apparatus comprising:

a robot table tennis ball serving device mounted to the table tennis table at one end thereof for serving balls to an opposite end of the table tennis table where a human player stands;

at least one movable low profile sensor, each such sensor capable of being placed at any desired location on a surface of such table tennis table which is on the same side of the table tennis net as the robot table tennis ball serving device so as to provide at least one predetermined randomly placed target for the human player when returning a table tennis ball from an opposite end of the table tennis table that is served by such robot table tennis ball serving device located at such one end of the table tennis table, each such sensor containing piezo film means for generating an electrical voltage upon an impact of a table tennis ball on each such sensor;

microprocessor means operably connected to each such sensor for integrating functions of said apparatus including means for preprogramming an assigned score value for each such sensor and means for preprogramming an increment of time;

means for comparing the electrical voltage from a table tennis ball impact on each such sensor with the preprogrammed increment of time of such microprocessor means; and means for calculating and displaying a digital score based on the difference between the preprogrammed score value and the preprogrammed increment of time;

whereby the occurrence of an electrical voltage within the preprogrammed increment of time resulting in the assigned score value being displayed for the human player and the non-occurrence of all electrical voltage within the preprogrammed increment of time resulting in the assigned score value being displayed for the robot table tennis ball serving device.

3. The invention of claim 2 wherein each sensor is an impact disc.

4. The invention of claim 3 and further comprising a piezo film sensor element bonded to a lower surface of a periphery of each impact disc, the piezo film sensor element constructed to generate an electrical impulse when an impact disc is struck by a table tennis ball.

* * * * *